US011261810B2

(12) United States Patent
Weber

(10) Patent No.: US 11,261,810 B2
(45) Date of Patent: Mar. 1, 2022

(54) METHOD OF CONTROLLING ENGINE COLD RESTART

(71) Applicant: Delphi Automotive Systems Luxembourg SA, Bascharage (LU)

(72) Inventor: Konrad A. Weber, Rehlingen-Siersburg (DE)

(73) Assignee: DELPHI AUTOMOTIVE SYSTEMS LUXEMBOURG SA, Luxembourg (LU)

( * ) Notice: Subject to any disclaimer, the term of this patent is extended or adjusted under 35 U.S.C. 154(b) by 0 days.

(21) Appl. No.: 17/286,570

(22) PCT Filed: Oct. 15, 2019

(86) PCT No.: PCT/EP2019/077891
§ 371 (c)(1),
(2) Date: Apr. 19, 2021

(87) PCT Pub. No.: WO2020/078955
PCT Pub. Date: Apr. 23, 2020

(65) Prior Publication Data

US 2021/0348574 A1 Nov. 11, 2021

(30) Foreign Application Priority Data

Oct. 19, 2018 (GB) ..... 1817029

(51) Int. Cl.
*F02D 41/06* (2006.01)

(52) U.S. Cl.
CPC ..... *F02D 41/064* (2013.01); *F02D 41/065* (2013.01); *F02D 2200/0614* (2013.01)

(58) Field of Classification Search
CPC ..... F02D 41/064; F02D 41/065; F02D 2200/0614
USPC ..... 123/435, 491; 701/103–105, 112, 113
See application file for complete search history.

(56) References Cited

U.S. PATENT DOCUMENTS

| | | | |
|---|---|---|---|
| 5,142,479 | A | 8/1992 | Poirier et al. |
| 5,781,877 | A | 7/1998 | Rachel et al. |
| 2002/0112695 | A1 | 8/2002 | Price et al. |
| 2004/0163629 | A1 | 8/2004 | Strayer et al. |
| 2005/0241619 | A1 | 11/2005 | Strayer et al. |
| 2011/0106412 | A1 | 5/2011 | Ma et al. |
| 2012/0143477 | A1 | 6/2012 | Ruona et al. |
| 2016/0047328 | A1 | 2/2016 | Buslepp et al. |

*Primary Examiner* — Hai H Huynh
(74) *Attorney, Agent, or Firm* — Joshua M. Haines

(57) ABSTRACT

A method of controlling the fuel air mixture of an internal combustion engine following a cold restart includes determining a control parameter based on the value of current coolant temperature at time of current engine start, the value of coolant temperature at time of the previous engine start, a calibratable reference temperature, the total accumulated fuel mass injected during previous engine run time, the time the engine was off before the restart, and the time the engine was run after previous start. The method also includes controlling the fuel air mixture based on said control parameter.

8 Claims, 3 Drawing Sheets

METHOD OF CONTROLLING ENGINE COLD RESTART

CROSS REFERENCE TO RELATED APPLICATIONS

This application is a national stage application under 35 USC 371 of PCT Application No. PCT/EP2019/077891 having an international filing date of Oct. 15, 2019, which is designated in the United States and which claimed the benefit of GB Patent Application No. 1817029.0 filed on Oct. 19, 2018, the entire disclosures of each are hereby incorporated by reference in their entirety.

TECHNICAL FIELD

This invention relates controlling an engine under cold restart conditions; the latter term refers to starting an engine in cold conditions after a previous period of running time of the engine. The invention has particular but not exclusive application to engines having cooling systems which include an electrically controlled rotary valve.

BACKGROUND OF THE INVENTION

Engine cold start and cold restart performance is a benchmark criterion for engines. OEMs define corresponding requirements which are mostly linked to the ambient temperature conditions in which the engine must be started safely and reliably. It is important to provide the engine with optimum fuel air mixtures during such cold or cold restart conditions, which takes into consideration performance and emission considerations. Thus, in respect of fuel injected engines, it is important to for the correct or optimum amount of fuel to be injected taking into concern such considerations. Often maximum starting times and engine speed overshoots (above the idle target speed) are specified as a requirement and they are taken as a criterion for the start and restart performance evaluation of the engine system. Furthermore, cold start emissions need to be reduced to the greatest possible extend to comply with emission legislation requirements. These items translate into performance requirements for the cold start and cold restart mixture adaptation methodology (adaptation logic) within the engine control software.

It should be noted that the first cold start of an engine and the following cold restart differ from each other in terms of mixture determination. Using the mixture of the first cold start for the restart will stall the engine in many of the cases. This is why a methodology is required to determine specific cold restart mixtures; i.e. cold restart mixture adaptation is required.

Usually prior art mixture adaptation systems use the parameter(s) of coolant or other system temperatures to determine/adapt the mixture for the cold start and also the cold restart. This is because the temperature of the engine is directly linked to how well the fuel evaporates in the air-fuel mixture which in turn determines the quality of the combustion and finally the capability to restart the engine particularly in cold ambient conditions.

In known systems cooling circuits often include two thermostats. Alternatively, engines are often equipped with an electronically controlled rotary valve in the cooling circuit (e.g. in addition to a single thermostat) to provide fast heat up of the coolant. Controlling the rotary valve typically leads to temperature fluctuations and this represents a challenge for prior art mixture adaptation systems because the current temperature level is not representative of the coolant and particularly the engine temperature, and hence no longer directly linked to how well the fuel evaporation and finally the combustion will be. With a closed rotary valve for example, the coolant will heat up quickly but the combustion chamber (walls) will be still relatively cold and hence more enrichment is required than the temperature-based mixture adaptation would suggest. This is why it is more difficult to adapt the mixture for cold restart on engines featuring a rotary valve. Aspects of the invention are applicable to engines with any cooling system including coolant systems without such a rotary valve.

It is an object of the invention to overcome the shortcomings of prior art mixture adaptation systems to solve the cold restart problem.

SUMMARY OF THE INVENTION

In one aspect is provided a method a method of controlling the fuel air mixture of an internal combustion engine on and subsequent to, a cold restart comprising:

a) determining a control parameter said control parameter being based on the following measured or modelled input parameters; the value of current coolant temperature at time of current engine start ($Tcool_{curstrt}$), the value of the coolant temperature at time of the previous engine start ($Tcool_{prestrt}$), a calibratable reference temperature ($T_{Ref}$), the total accumulated fuel mass injected during previous engine run time ($mfuel_{prestrt}$), the time the engine was off before the restart ($t_{engoff}$) and the time the engine was run after previous start ($t_{engrun}$)

b) controlling the fuel air mixture based on said control parameter.

Said control parameter may be an MAI index, and may be determined from the following equation:

$$MAI\,[g^{-1}K] = \frac{\left(\frac{(T_{cool_{curstrt}} - T_{cool_{prestrt}})}{\mathrm{abs}(T_{Ref} - T_{cool_{prestrt}})}\right)}{mfuel_{prestrt} * \left(\frac{t_{engoff}}{t_{engrun}}\right)}$$

The MAI index value may be used to determine an offset value, indicating a relative enrichment; and in step b) the relative enrichment is used controlling the fuel air mixture.

Said enrichment may be relative to FSM.

Subsequent to engine restart said offset value may decreases with time

Said offset value may decay with a time constant $\tau$.

The offset index value may be determined from a stored MAP or table.

Said decay time or $\tau$ is proportional to the MAI or offset value may be initially determined on engine restart.

Said initial offset may be determined form MAI and engine run time.

Said coolant system may include an electrically controlled rotary valve.

The term "cold restart" refers to a restart of the engine following a first cold start.

BRIEF DESCRIPTION OF THE DRAWINGS

The present invention is now described by way of example with reference to the accompanying drawings in which.

DESCRIPTION OF THE PREFERRED EMBODIMENTS

Figure 1:
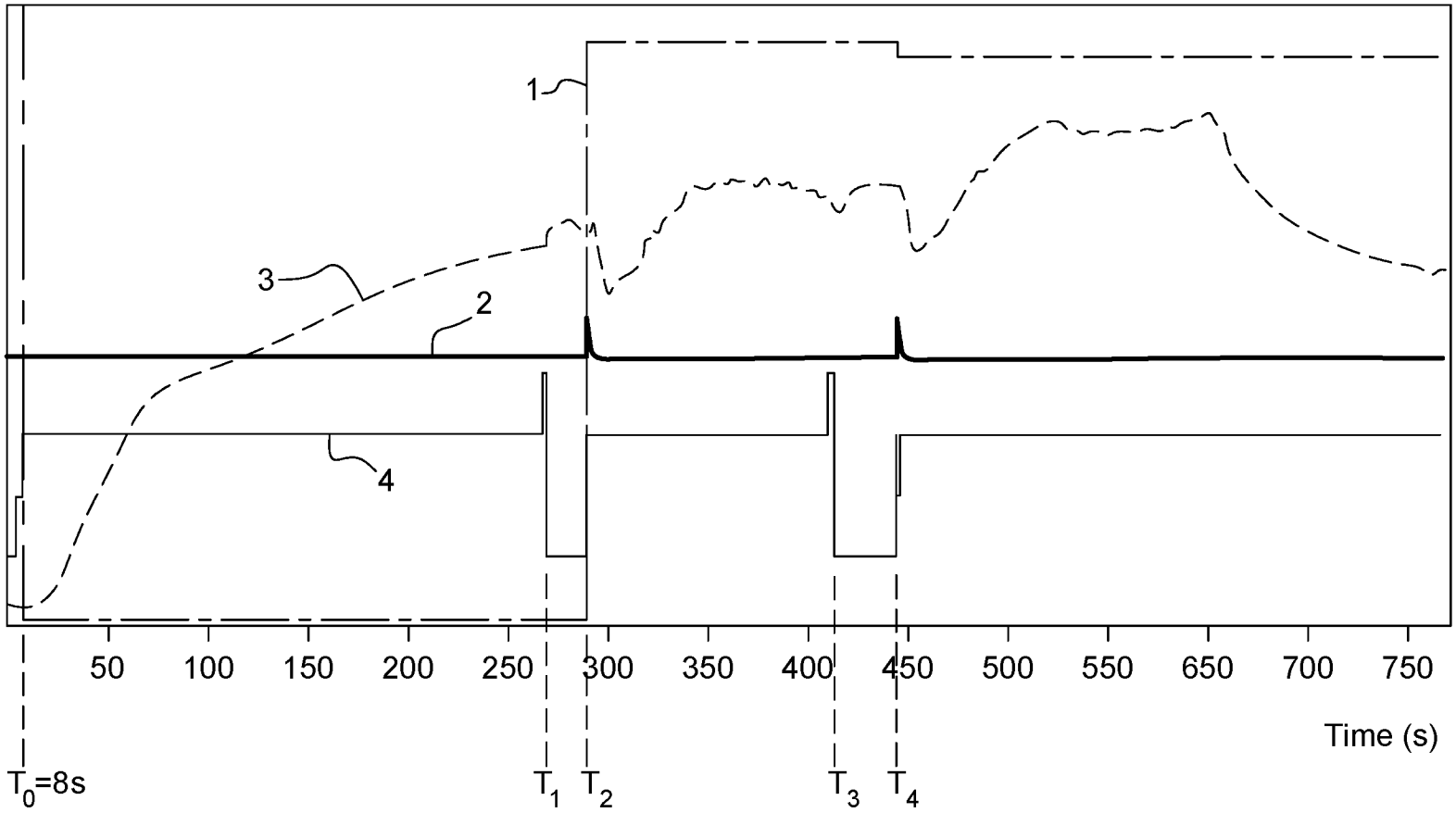
FIG. 1 shows a plot of various parameters against time in the case of a very cold engine start at −31° C. at 8 s followed by a first restart at 290 s, FIG. 2 below depicts plot of various parameters the first cold restart of FIG. 1 at about 290 s in a larger scale.

Compared to the first engine cold start for which a fixed mixture determination base map is used (First-Start-Mixture—FSM), aspects of the invention provided that the mixture of each individual restart is adapted; so as to determine the level of fuel supplied to the fuel injectors in order to ensure successful and reliable restarts (avoiding engine stalls) on the one hand and minimize engine cold start emissions on the other hand.

This may be performed by determining whether further enrichment of the FSM is required or not and if required, how much of enrichment is required. FSM is a known term and FSM can be determined (e.g. by map calibration) as function of cumulative injected fuel (or air) and coolant temperature, so it (FSM) accounts for a "cold" as well as for a "warm" first engine start.

The inventors have determined that the restart mixture ensuring good cold restart performance mainly depends on relevant temperatures as well as on previous engine run and also on engine off times. Furthermore, considering the fact that today's engines often feature a rotary valve in the cooling circuit for fast heating, in one aspect the following parameters are used to determine cold restart mixture (adaptation function):

a) coolant temperature at time of current engine start (e.g. restart)

b) coolant temperature at time of previous engine start (e.g. very first start)

c) amount of fuel injected during previous engine run time d) engine off time before restart e) engine run time before restart In one aspect these parameters are thus used to determine cold start mixtures and consequently the amount of fuel to be injected on cold start. The coolant temperature may be determined form temperature sensor anywhere in or adjacent to the cooling system.

In one particularly advantageous example, a normalized mixture adaptation index (MAI) is determined, derived from above mentioned parameters. This can be then used to determine air fuel mixture and hence injection quantities. The index value may be used to indicate the necessary fuel air mixture (enrichment) subsequent to cold restart (or e.g relative enrichment relative to FSM) to ensure good cold restart performance A small index value indicates that the FSM only needs to be slightly enriched whereas a high value indicates more important enrichment.

The MAI may be used as a direct input into calibration maps in which offsets from the FSM can be calibrated (i.e. as a function of the map inputs such as the MAI). The MAI can directly be used as map input and hence facilitates the calibration task for cold restart mixture adaptation and cold restart emissions optimization. Aspects of the invention provide a quantifiable indication of the necessary (and sufficient) cold restart enrichment ensuring reliable cold restart performance. The MAI may be calculated (updated) before restarting the engine which allows adequate start-mixture determination (adaptation) through calibration maps which also will influence the mixture during the cranking, after-start and the following warm-up phase.

Aspects are particularly applicable on engines featuring a rotary valve in the cooling circuit because the MAI is calculated based on snapshotted (constant) inputs rather than on current values. This makes the MAI robust against temperature fluctuations that occur due to rotary valve operations and that can lead to incorrect mixture adaptation.

Parameters from the previous engine run(s) may be stored to calculate a valid MAI also after power latch or extended engine off times. Hence the MAI in aspects may use the "history" of the previous combustion to calculate the required mixture for the restart.

The MAI index value is consistent, reproducible and can provide reliable information.

In one aspect the MAI is defined by the below equation $$MAI\,[g^{-1}K] = \frac{\left(\frac{(T_{cool_{curstrt}} - T_{cool_{prestrt}})}{\mathrm{abs}(T_{Ref} - T_{cool_{prestrt}})}\right)}{mfuel_{prestrt} * \left(\frac{t_{engoff}}{t_{engrun}}\right)}$$

Where:

$Tcool_{curstrt}$: Value of current coolant temperature at time of current engine start $Tcool_{prestrt}$: Value of coolant temperature at time of the previous engine start $T_{Ref}$: Calibratable reference temperature $mfuel_{prestrt}$: Total accumulated fuel mass injected during previous engine run time $t_{engoff}$: Time the engine was off before the restart $t_{engrun}$: Time the engine was run after previous start.

The calibratable reference temperature should represent the coolant temperature of a warm engine, meaning an engine that is operating at its specified working temperature. The reference temperature is an important parameter since it defines, for any restart, the (remaining) temperature delta "seen" by the (previous) restarts (gap between restart temperature and the "warm engine" temperature). This can be seen in the index formula. The absolute value of $T_{Ref}$−$Tcool_{prestrt}$ represents the complete "warming gap" and it is taken as a weighting factor that evaluates (normalizes) the amount of "warming realized" ($Tcool_{curstrt}$−$Tcool_{prestrt}$) during the previous engine run (warming actually contributed) to finally reach the reference temperature. The resulting index value is then taken to adapt the mixture for the current restart. Using the reference temperature, the nominator of the index is weighting the impact of the "combustion history" with the overall "warming gap" of the engine and updates this calculation at each restart.

Here abs refers to the mathematical function that yields the absolute value of a term, here, a temperature difference. Applying abs always returns a positive value. The temperature may be in Kelvin.

Example 1

Figure 2:
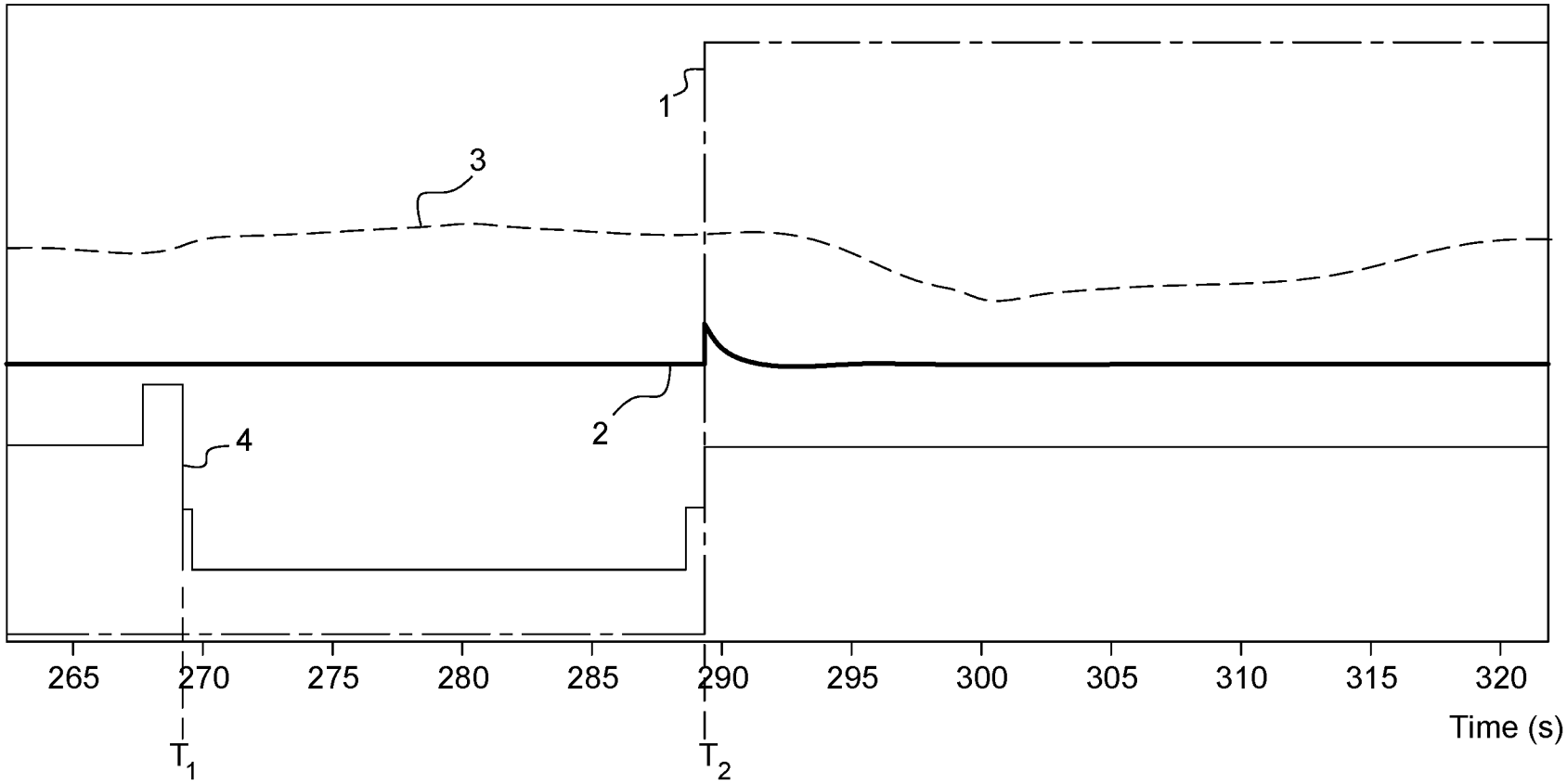

FIG. 1 shows the parameters of MAI, 1 and a mixture offset signal, 2 calculated for the case of a very cold engine start at −31° C. at 8 s (T0) followed by a first restart at 290 s (T2), with the update of the MAI just before the restart. FIG. 2 below depicts the first cold restart at ~290 s in a larger scale with the decaying offset signal that has been calculated using the MAI.

At time T1 the engine is turned off. In the figures reference numeral 3 is coolant temperature and 4 is the engine mode. For the engine start and stop times: if plot 4 drops down, this is the engine stop event, when it goes up again, this is engine start.

$Tcool_{curstrt}$: 56.75° C.

$Tcool_{prestrt}$: −31.75° C.

$T_{Ref}$: 90° C. (calibration)

mfuel: 150 g $t_{engoff}$: 20.08 s (T2−T1)

$t_{engrun}$: 261.7 s (T1−T0)

Putting these numbers into the equation gives a value of 0.063157 for the MAI which is also found at T2 for the signal/line 1.

Once determined the MAI can be used to control the mixture in engine operation by e.g. appropriate control of the amount of fuel injected e.g. during a cold restart period. In a very simple embodiment the MAI is used to determine from a simple look up table or MAP, to determine the fuel mixture for a certain time until the engine warms up to a particular level; this time period may be variable according to certain parameters such as ambient temperature, time between engine start and restart, initial temperature etc.

The MAI can be used as an input to calibration tables or maps to adapt the mixture.

In refined embodiments, the index value may be used to indicate the necessary relative enrichment (e.g. relative to FSM) to ensure good cold restart performance.

As the engine warms up after the cold restart, gradually less extra fuel will be required compared with at the time of engine restart, so the offset amount of additional fuel can be reduced over time. The skilled person would be aware of methodology of how this could be done. For example a decay model may be used where the additional fuel to compensate for a non-warmed up engine may be reduced according to a decay model or control function, which may include one or more parameters as inputs.

In one example according to enhanced methodology (adaptation logic), the index is used to generate an offset value (decaying signal line 2 in the figure) which is then subtracted from the FSM to finally implement the cold restart mixture adaptation. Again, the offset signal may decay with time as the engine warms up. In examples such as that shown, the peak height of the decaying offset signal 2 is proportional (calibratable) to the magnitude of the MAI (determined at the point of engine cold restart). The peak height of the decaying offset signal 2 is proportional (calibratable) to the magnitude of the MAI. An appropriate control strategy may be used to determine the decay.

So in one example MAI at the engine restart time is determined and this is used to generate an offset value (to be applied to the FSM) by e.g. looking at MAP/calibration table. This offset may decay over time as the engine warms up. The skilled person would be able to apply a decay regime for control with a varying rate of decay dependent on e.g. one or more parameters.

So a time constant $\tau$ (or $\lambda$) may be applied to a decay of the offset signal possibly dependent on one or more parameters.

In one example the MAI can be used as an input to a look-up table that determines the height of the "peak" (transient enrichment adaptation) and the decay time of the "peak" may be calibrated as function of the height.

The initial offset value may be determined from the MAI on cold restart (i.e. is a function thereof found by e.g. look-up table or formula) and the delay time ti is a function of the MAI or initial value of the offset signal (at engine cold restart).

The MAI may be input to a three-dimensional map to determine height of offset signal (DT1 peak). The other input we use (apart from the MAI) as input to the 3D map is the engine run time before restart.

Figure 3:
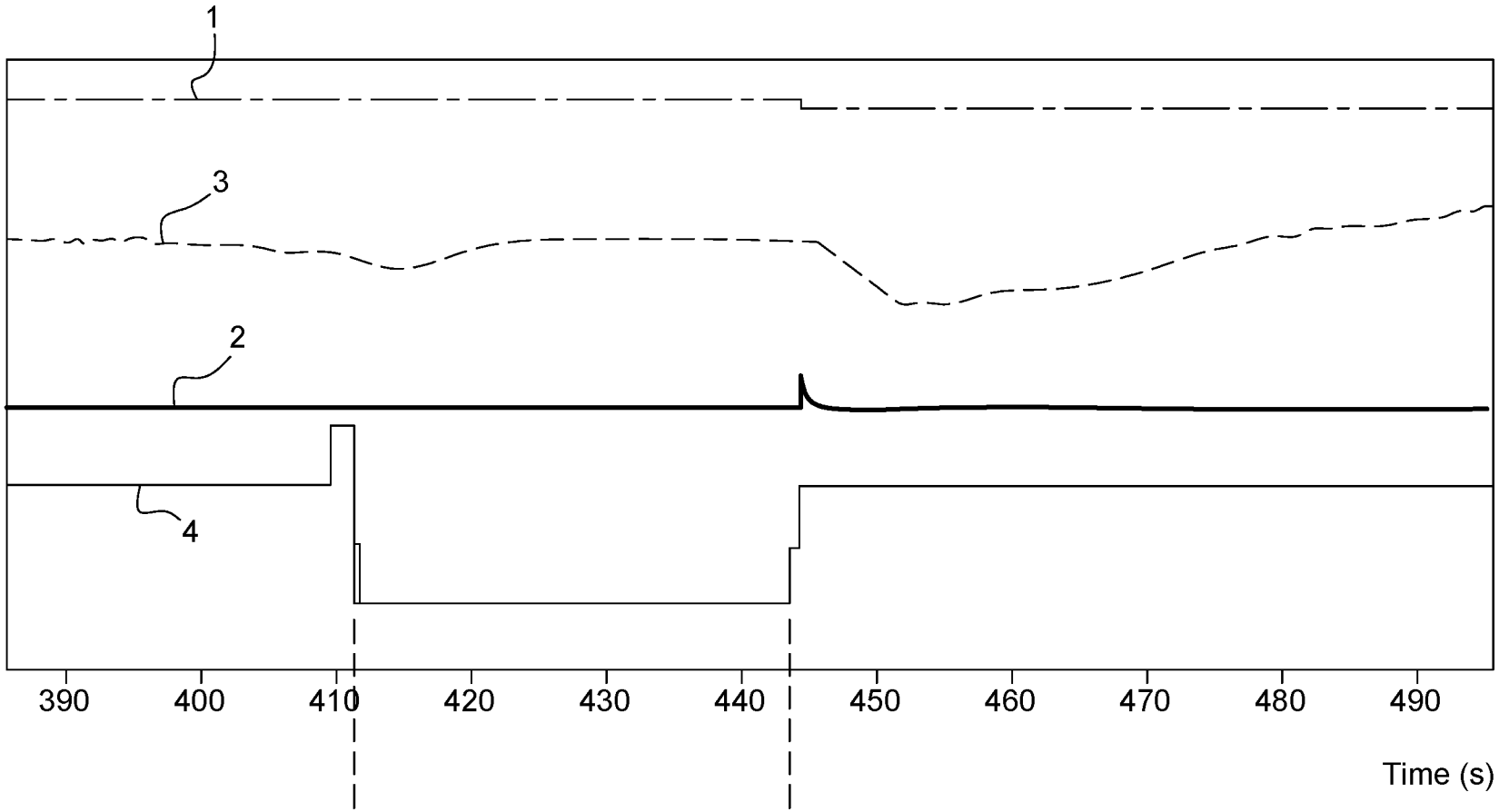
FIG. 3 shows plot of various parameters against time with a second cold restart at about 445 s.

FIG. 1 also shows a second cold restart at T4, after the engine is turned off at T3. FIG. 3 shows this in larger detail and the data of this second cold restart at ~445 s with the update of the MAI and the corresponding FSM offset signal which is smaller in height since the MAI is also smaller for the second restart.

A large MAI value typically results from a previous engine run during which only a small amount of fuel is injected (e.g. engine idling) while at the same time the rotary valve is closed to provide fast coolant heat up. This is the classical case in which the combustion chamber is still relatively cold whereas the temperature of the coolant is already quite high (thanks to the rotary valve). In this condition the current temperature alone is not representative (not valid) for the restart mixture adaptation and hence a greater enrichment will be required for the restart. This however is correctly indicated by the value (big value) of the MAI. A small index value usually results from a previous high (or higher) load run (injected fuel quantity is big) which increases the absolute value of the denominator and hence decreases the value of the MAI. Concerning mixture adaptation, such a condition is closer to the FSM because the coolant temperature is more representative for the mixture adaptation (since the combustion chamber now really has become warm enough) and hence only little (or no) enrichment as compared to the FSM is required for the restart.

The MAI always represents an offset to the current FSM applied when restarting the engine. With regards mixture determination, the FSM is (of course) also "active" at each restart, and the MAI is there to correct the incorrect mixture that the FSM would derive due to the "invalid" coolant temperature information it is using as map input.

It was proven that when using the MAI for the restart mixture adaptation determination, the engine can be reliably restarted at all customer defined temperature levels (down to −32° C.) with different engine run times, varying engine off times before the restart and various engine loads.

Aspects of the invention provides a quantifiable measure of the necessary mixture adaptation before the engine is restarted and hence can "anticipate or predict" the correct start mixture (value of enrichment at restart) allowing for successful restart. Prior art systems rather adapt the mixture after the engine has been restarted without having any upfront knowledge and hence can only react to eventual combustion instabilities or engine speed drops. The "reaction" however often comes too late.

Aspects of the invention uses both, currently available information as well as stored (history) information from the previous engine start and "compresses" this information into a single index value. Prior art systems usually use "live", current information directly (e.g. temperatures as map inputs) for mixture adaptation.

The invention provides functionality that is insensitive with regards to coolant temperature fluctuations which are typically seen on engines featuring a rotary valve. On prior art systems, this usually has to be compensated by interpolating between many different maps or modes.

Invention facilitates the calibration task since it provides a feature that requires less maps than prior art systems would need to achieve the same result. This is because the MAI incorporates already the most important relevant information necessary for restart.

The advantages of the invention over the prior art are that a cold restart mixture adaptation information is made available in form of a numerical index (MAI). The MAI index "compresses" the most important parameters that are relevant for the cold restart mixture adaptation into a single number and hence less calibration maps are necessary within the mixture adaptation logic.

Calibration task is easier since the value of the MAI is consistent and reproducible, and it can directly be used as an input to calibration maps.

The value of the MAI is available before the engine is restarted. To a certain extent, the MAI "predicts" the necessary mixture adaptation for the coming cold restart and hence the mixture adaptation logic can act "upfront" by determining the correct restart enrichment instead of reacting when the engine has already been started.

The MAI index and aspects of the invention uses "combustion history footprint" of last start in terms of delta temperature (nominator) as well as previous off and run times and previous injected fuel quantity. It ensures more reliable engine restarts under cold ambient operating conditions. The methodology reduces cold start emissions if calibration is optimized since the MAI allows to provide only the necessary but sufficient adaptation (e.g. optimized enrichment—only as rich as needed to allow engine restart).

In a summary generally the higher the coolant temperature (not the ambient) the less enrichment is needed (given that the coolant temperature really shows how warm or cold the components are that take part in the combustion—which is not always the case and which is the scope of this invention). When there is a first start the engine using FSM, then stop shortly after and restart, in this condition, the coolant temperature probably would not have increased a lot (even with rotary valve) so that the FSM would still be able to restart the engine. In this case the MAI should indicate a very small value (almost zero) which indicates that almost no further enrichment compared to the FSM is required. However if the engine has run some time (e.g. 15 s) after the first start, then coolant has already increased and in this case the MAI would indicate a higher value to provide more enrichment to follow for the fact of "nonvalid" coolant temperature information.

The MAI thus may represent an offset to the current FSM applied when restarting the engine. As the "backbone" of the mixture determination, the FSM is (of course) also "active" at each restart, and the MAI is there to correct the incorrect mixture that the FSM would derive due to the "invalid" coolant temperature information it is using as map input.

With a very, very short first engine run time, the coolant temperature might almost be the same as on the first start. In this case the MAI will be very, very small which indicates that almost no further enrichment is needed.

The invention claimed is:

1. A method of controlling fuel air mixture in an internal combustion engine during, and subsequent to, a cold restart, said method comprising:

a) determining a control parameter based on the following measured or modelled input parameters: coolant temperature at time of current engine start, coolant temperature at time of a previous engine start, a calibratable reference temperature, a total accumulated fuel mass injected during previous engine run time, time the engine was off before restart, and time the engine was run after previous start; and b) controlling the fuel air mixture based on said control parameter where said control parameter is a mixture adaptation index (MAI), determined from the following equation:

$$MAI\,[g^{-1}K] = \frac{\left(\frac{(T_{cool_{curstrt}} - T_{cool_{prestrt}})}{\mathrm{abs}(T_{Ref} - T_{cool_{prestrt}})}\right)}{mfuel_{prestrt} * \left(\frac{t_{engoff}}{t_{engrun}}\right)}$$

where $Tcool_{curstrt}$ is the coolant temperature at time of current engine start, $Tcool_{prestrt}$ is the coolant temperature at time of the previous engine start, $T_{Ref}$ is the calibratable reference temperature, $mfuel_{prestrt}$ is the total accumulated fuel mass injected during previous engine run time, $t_{engoff}$ is the time the engine was off before restart, and $t_{engrun}$ is the time the engine was run after previous start.

2. A method as claimed in claim 1, wherein a MAI value is used to determine an offset value, indicating a relative enrichment; and in step b) the relative enrichment is used to control the fuel air mixture.

3. A method as claimed in claim 2, wherein said relative enrichment is relative to a first start mixture.

4. A method as claimed in claim 2, wherein subsequent to engine restart, said offset value decreases with time.

5. A method as claimed in claim 4, wherein said offset value decays with a time constant.

6. A method as claimed in claim 4, wherein the MAI value is determined from a stored map or table.

7. A method as claimed in claim 6, wherein said time constant is proportional to the MAI value or said offset value.

8. A method as claimed in claim 7, wherein said offset value is determined from said MAI value and engine run time.

* * * * *